United States Patent [19]

Tanner

[11] 4,117,667

[45] Oct. 3, 1978

[54] SEGMENTED BAND

[76] Inventor: Willi Tanner, 43 Hirschengraben, Luzern 6000, Switzerland

[21] Appl. No.: 800,583

[22] Filed: May 25, 1977

[30] Foreign Application Priority Data

Jun. 2, 1976 [CH] Switzerland ..... 006899/76
Oct. 11, 1976 [CH] Switzerland ..... 012912/76

[51] Int. Cl.[2] ..... F16G 13/18
[52] U.S. Cl. ..... 59/80
[58] Field of Search ..... 59/80, 82, 78, 79 B; 63/4; 224/4 H

[56] References Cited

U.S. PATENT DOCUMENTS

| | | | |
|---|---|---|---|
| 385,313 | 6/1888 | Lenau | 59/80 |
| 1,445,564 | 2/1923 | Stafford | 59/80 |
| 3,190,067 | 6/1965 | Kammerer | 59/79 B |
| 3,274,767 | 9/1966 | Henschel | 59/79 B |
| 3,857,237 | 12/1974 | Brauchi | 59/80 |

*Primary Examiner*—C.W. Lanham
*Assistant Examiner*—Gene P. Crosby
*Attorney, Agent, or Firm*—William Anthony Drucker

[57] ABSTRACT

A segmented band with profile segments, in which the profile segments have a U-profile form, the legs of which form side walls having projecting arms which are equipped with hooks on their ends. The wall section between the arms is intended to hold connecting links, each link having a longitudinal groove intended to hold together the side wall sections, lying between the arms of two neighboring U-profile segments. Closure means are provided to engage in the hooks of said arms which serve to prevent the connecting links for slipping out of the U-profile segments.

4 Claims, 12 Drawing Figures

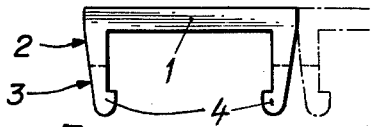
Fig.1
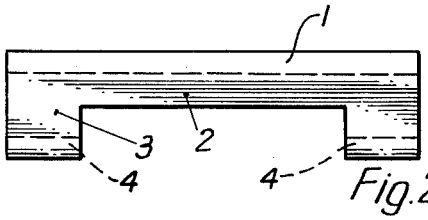
Fig.2
Fig.3
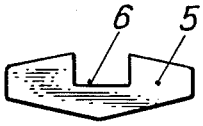
Fig.4
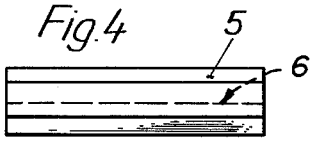
Fig.5
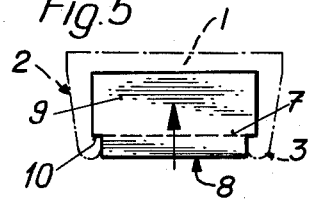
Fig.6
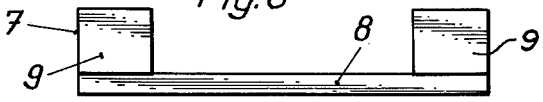
Fig.7
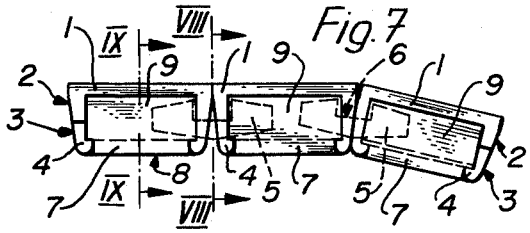
Fig.8
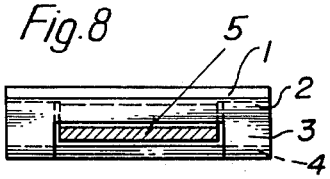
Fig.9
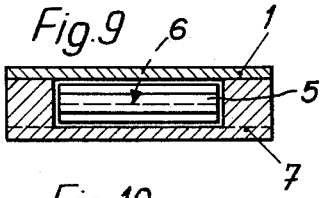
Fig.10
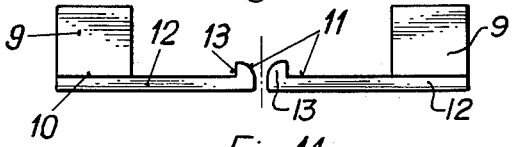
Fig.12
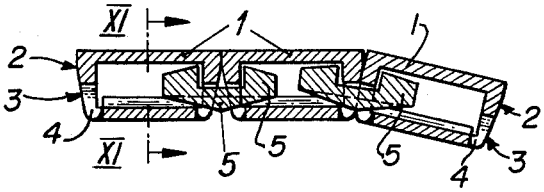
Fig.11
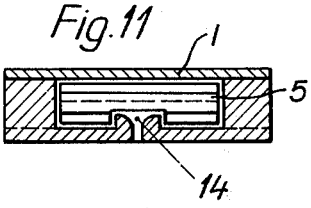

SEGMENTED BAND

The invention concerns a segmented band with profile segments the profile surface of which ressembles an equilateral trapezium on the outside and is right-angled on the inside, and the two adjacent side walls, lying crosswise to the band direction, of two neighbouring profile segments held together by at least one connecting link in such a manner that the profile segments are manoeuvrable around edges lying close to the ends of the longer base of the trapezium.

Known segmented bands show, on the inside, flexible woven-metal bands, eg. Milanaise woven bands or spring elements, the installation of which calls for a relatively thick band which, especially for ornamental purposes, is undesirable. When such bands are bent, unaesthetical spaces arise on the outside of the band (visible side) between the individual segments.

A segmented band by the same inventor has already been protected (CH-Patent Nr. 439,836) which has hollow profile segments the profile surface of which corresponds approximately to an equilateral trapezium on the outside and is right-angled on the inside. Two side walls each of two neighbouring profile segments are held together on both sides of the band by one connecting bracket in such a way that practically no spaces can arise between the segments. To prevent the connecting links from slipping out of the hollow profile segments, stop plates are provided which are attached by means of hard solder or bent down flaps.

It is of disadvantage that the manufacture by hard soldering or bending in the flaps is laborious and therefore causes relatively high manufacturing costs. In addition, the replacement of parts of the band, shortening or lengthening the band, can only be performed by an expert.

These disadvantages are to be met by the segmented band according to the invention so that automatic assembly by machine is made possible and segments can be added or removed also by laymen.

The segmented band is characterized in that the profile segments have a U-profile form the legs of which, as side walls, show protruding arms which are provided with hooks at their ends, and the wall section between the arms is intended to hold the connecting link, in that the connecting link has a longitudinal groove intended to hold together the side wall parts, lying adjacent between the arms, of two neighbouring U-profile segments, in that the upper and lower limiting surface of the connecting links are sloped to enable the manoeuvrability of the U-profile segments, and in that a means of closure is provided to fit into the hooks of the arms which serves to prevent the connecting links slipping out of the U-profile segments.

The drawing shows two examples of execution of the object of the invention as follows:

FIG. 1 side view of the U-profile segment, greatly enlarged,

FIG. 2 front view of the same,

FIG. 3 side view of a connecting link, greatly enlarged,

FIG. 4 front view of the same,

FIG. 5 side view of a band closure piece, greatly enlarged,

FIG. 6 front view of the same,

FIG. 7 side view of a band section, somewhat enlarged,

FIG. 8 cross-section of the band along the line VIII—VIII in FIG. 7,

FIG. 9 cross-section of the band along the line IX—IX in FIG. 7,

FIG. 10 side view of a two-piece band closure, greatly enlarged,

FIG. 11 section along the line XI—XI in FIG. 12, somewhat enlarged and

FIG. 12 longitudinal section of a band section with two-piece band closure, somewhat enlarged.

The segmented band (FIG. 7) incorporates a plurality of U-profile segments 1 (FIG. 1, 2). The outer profile lines of the segment bound an equilateral trapezium so that the bridge portion of the segment corresponds to the longer base of the trapezium. The inner profile corners form a right angle. The legs of the U-profile segment 1 form the side walls 2 of the same. At the ends of the profile segment 1, the walls 2 are equipped with arms 3 on the ends of which hooks 4, directed inwards, are provided. The recess in the wall between the arms 3 receives the connecting link 5 (FIG. 3, 4). The latter shows a longitudinal groove 6 to hold together the side walls 2, lying crosswise to the band direction, of two neighbouring U-profile segments 1 (FIG. 3, 4, 7). The length of the connecting link 5 is somewhat less than the inner distance between the arms 3 of the U-profile segment (FIG. 2), whereas the thickness of the connecting link 5 corresponds approximately to the distance between the profile bridge portion and the hook 4 (FIG. 1, 2, 7, 8) so that the lower half of the connecting link 5 can be held in the space between the arms 3. The outer edges of the groove 6 thus lie by the inner edges, on the bridge side, of the U-profile segment 1 which lie close to the ends of the longer trapezium base. Thus the U-profile segments are manoeuvrable around the outer edges of the groove 6 of the connecting link 5 and practically around the inner profile edges, so that no undesirable space can arise between the profile segments 1. The upper and lower limiting surfaces of the connecting link 5 are slanted in both band directions to enable the manoevrability of the profile segments 1 (FIG. 3, 7).

To prevent the connecting links 5 from slipping out sideways or downwards from the U-profile segments 1, closure segments 7 are provided as closure pieces (FIG. 5 and 6). The segmented band according to FIG. 7 to 9 shows one-pieced closure segments. A bridge 8 is connected at each of its ends with a closing head 9. These heads 9 are equipped underneath with grooves 10 so that they can be engaged, as indicated in FIG. 5, in the U-profile segment, whereby they are held fast by the hooks 4.

In the case of broad segmented bands, two connecting links 5 can be provided adjacent to one another. The profile walls are then equipped with an additional arm 3, 4 in the middle.

In the form of execution according to FIG. 11, 12, the segmented band shows, as means of closure, a pair of segments 11 with two identical halves (FIG. 10). Each half is equipped with a closure head 9 to which a flat piece 12 is attached, the end of which has a hook 13. Both segment halves are slid into the U-profile segment laterally and symmetrically to one another, so that their hooks 13 engage in a transverse groove 14 of the connecting link 5 (FIG. 11).

The segmented band which is constructed with only three different pieces, the U-profile segment 1, the connecting link 5 and the closure segment 7, 11, can be developed as a metal band, especially as an ornamental or watch band.

I claim:

1. A segmented band with profile segments the profile surface of which ressembles an equilateral trapezium on the outside and is right angled on the inside, and two adjacent side walls each lying crosswise to the band direction, and two neighbouring profile segments being held together by at least one connecting link in such a way that the profile segments are manoeuvrable along edges lying adjacent to each other, characterized in that the profile segments have a U-profile form the legs of which form said side walls having projecting arms which are equipped with hooks on their ends, and the wall section between the arms is intended to hold the connecting link, in that the connecting link shows a longitudinal groove intended to hold together the side wall sections, lying between the arms, of two neighbouring U-profile segments, in that upper and lower limiting surfaces of the connecting link are slanted to enable the manoeuvrability of the profile segments, and in that closure means are provided to engage in the hooks of the arms which serve to prevent the connecting links from slipping out of the U-profile segments.

2. A segmented band according to claim 1, characterized in that, as means of closure, a closure segment is provided which shows a bridge to each end of which a stop head is attached, which heads are equipped underneath with grooves to engage with the hooks.

3. A segmented band according to claim 1, characterized in that a pair of segments with two identical halves is provided as means of closure, each having a flat piece with terminal hooks, which hooks can engage in a transverse groove provided underneath in the middle of the connecting link.

4. A segmented band according to claim 1, characterized in that it is developed as a metal band, in particular as an ornamental or watch band.

* * * * *